US005623953A

United States Patent [19]

McDowell

[11] Patent Number: 5,623,953

[45] Date of Patent: Apr. 29, 1997

[54] HAIR STYLING TOOL AND METHOD

[76] Inventor: Edwin P. McDowell, 345 Coosa Dr., Cropwell, Ala. 35054

[21] Appl. No.: 529,031

[22] Filed: Sep. 15, 1995

[51] Int. Cl.[6] ..... A45D 7/00

[52] U.S. Cl. ..... 132/210; 132/200; 132/245; 132/207; 132/217

[58] Field of Search ..... 132/210, 245, 132/246, 247, 256, 257, 223, 224, 225, 207, 217, 200; D28/39, 40, 41

[56] References Cited

U.S. PATENT DOCUMENTS

| | | | |
|---|---|---|---|
| 391,476 | 10/1888 | Lamb . | |
| 763,597 | 6/1904 | Daughters | 132/273 |
| 789,686 | 5/1905 | Dunlap | 132/247 |
| 1,117,021 | 11/1914 | Frey . | |
| 1,763,960 | 6/1930 | Girard . | |
| 2,066,709 | 1/1937 | Adams | 132/246 |
| 2,195,803 | 4/1940 | Willat | 132/207 |
| 4,955,401 | 9/1990 | Parsons | 132/245 |
| 5,499,638 | 3/1996 | Ripley | 132/246 |

*Primary Examiner*—Gene Mancene
*Assistant Examiner*—Pedro Philogene

[57] ABSTRACT

A hand-operated hair styling tool and method is disclosed wherein a pair of elongated rods or tubes are connected to each other at one end by a flexible hinge-like member. An alternate embodiment is also disclosed wherein the tool is constructed of a single "V" shaped rod or tube. The tool is used to rotate, twist and pull the hair of an individual into a variety of styles by grasping or clamping the section of hair to be styled between the two rods and then twisting or rotating the hair towards the, subject's head. Once the appropriate style has been completed the tool is slidably removed from the styled hair and the style is secured by combs or hair pins.

15 Claims, 3 Drawing Sheets

HAIR STYLING TOOL AND METHOD

BACKGROUND OF THE INVENTION

I. Field of the Invention

This invention relates generally to hair styling tools and accessories useful within the hair styling industry and to the general public and relates more specifically to a simplified hair styling tool which allows its user to quickly and easily twist, rotate and pull hair into a variety of fashion styles.

II. Prior Art and Other Considerations

The tediousness of styling hair, particularly very long hair, for clientele has always been a major problem for professional hairdressers and beauticians. Generally, clients with very long hair will spend from one to two hours in a hair styling salon in order to have their hair styled. Some styles, such as the "French Twist", "Pony Twist", "French Knot" and others, typically require very labor intensive sessions with a professional hairdresser whereby the hair is teased, combed and pinned until the desired style or effect is produced.

Devices, such as those disclosed in U.S. Pat. No. 1,117,021 and U.S. Pat. No. 1,763,960, were developed to assist the hair stylist in creating permanent waves or curls in ones hair. However, a need exists within the hair styling industry, for a tool which will allow the hair stylist and other individuals to quickly and easily twist, rotate and shape hair, especially long hair, into a variety of "styles" for themselves and their customers.

SUMMARY OF THE INVENTION

According to an embodiment of the invention, a hair styling tool comprises two rigid elongated rods or tubes connected to each other at one end by a flexible hinge-like member. An alternate embodiment of the invention comprises a "V"-shaped member of singular construction.

In view of the foregoing, it is a primary object of this invention to provide a hair styling tool and method which will allow its user to easily twist and style hair into a variety of styles virtually within minutes.

An advantage of the present invention is the provision of a simplified method and apparatus which allows the creation of hair styles which would be virtually impossible to create without the apparatus.

Another advantage of the present invention is the provision of method and apparatus for styling hair which is very fast and which substantially reduces the time required to complete a job over conventional methods.

Another advantage of the present invention is the provision of method and apparatus which is extremely lightweight, durable, easy to handle and economical to manufacture.

Yet another advantage of the present invention is the provision of a hair styling tool and method which, unlike other hair styling accessories, is not required to remain in the hair as a means to secure and hold the desired style in place after completion of the styling job.

BRIEF DESCRIPTION OF THE DRAWINGS

The foregoing and other objects, features, and advantages of the present invention will be apparent from the following more particular description of preferred embodiments as illustrated in the accompanying drawings in which reference characters refer to the same parts throughout the various views. The drawings are not necessarily to scale, emphasis instead, being placed upon illustrating the principles of the invention.

DETAILED DESCRIPTION OF THE DRAWINGS

Figure 1:
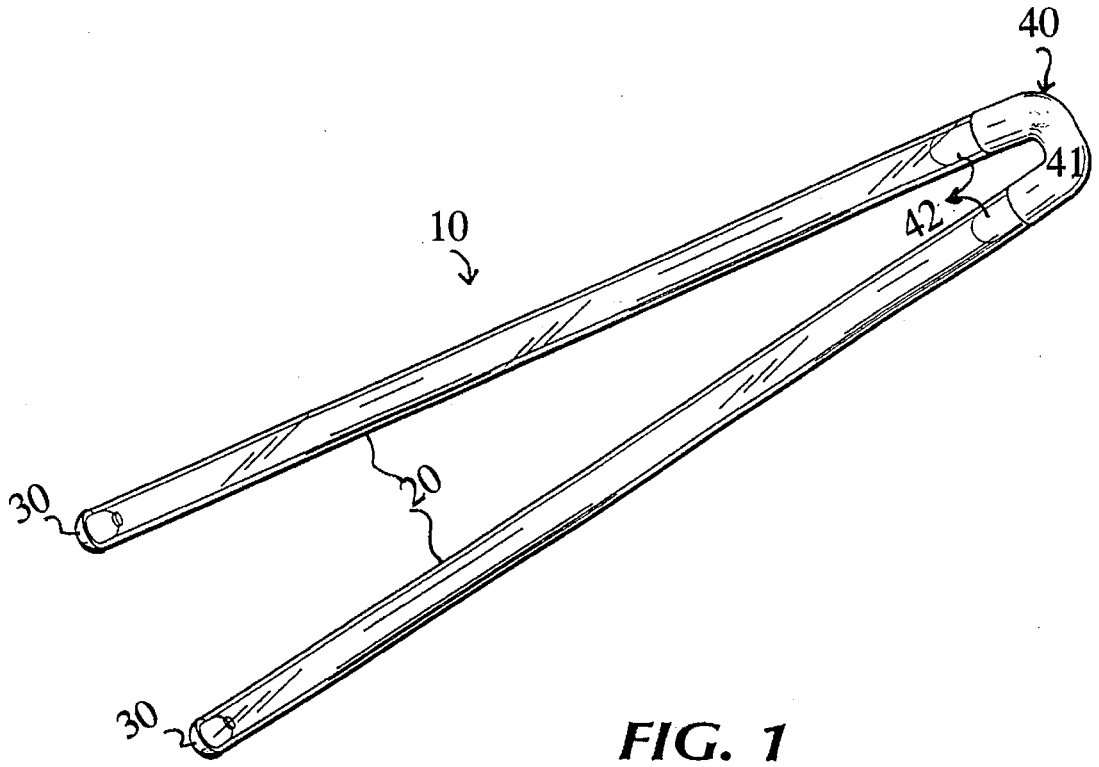
FIG. 1 is a plan view of an embodiment of the invention.

FIG. 1 shows a hair styling tool 10 in accordance with an embodiment of the invention. The tool 10 of FIG. 1 comprises two rigid elongated tubes 20 joined at one end by a flexible, hinge-like coupling 40. End plugs 30 are provided for the ends of said tubes 20 which are not attached to said coupling 40. The flexible coupling 40 is constructed of semi-rigid material such as rubber or the like and comprises a "V" shaped member 41 having protruding ends 42 which are sized to frictionally engage the inside diameter of said elongated tubes 20. The coupling 40 is flexible enough to allow the tubes 20 to be operated or moved toward each other in a clamping manner. The tubes 20 are constructed of rigid acrylic resin or other rigid plastic material and are of sufficient length to allow the user to grasp or clamp, in a "tweezers" fashion, a length of hair and to be able to hold, rotate, twist and pull the hair into a particular style as shown in FIGS. 3, 4, 5 and 6.

Figure 4:
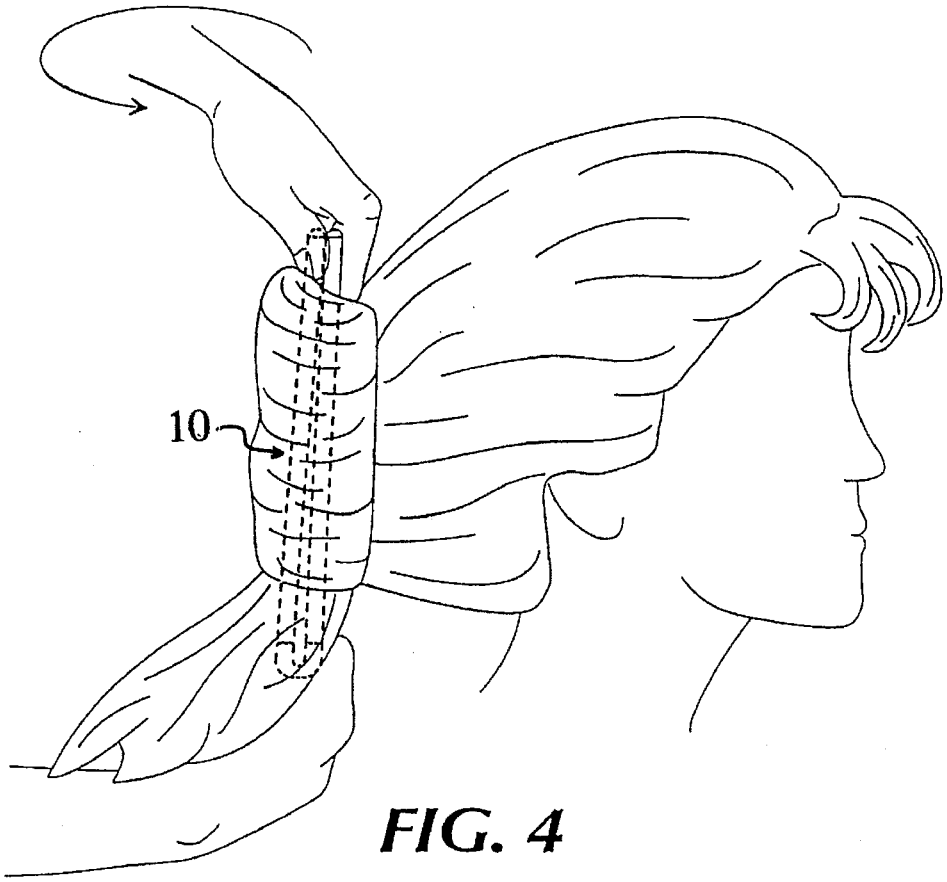
Figure 5:
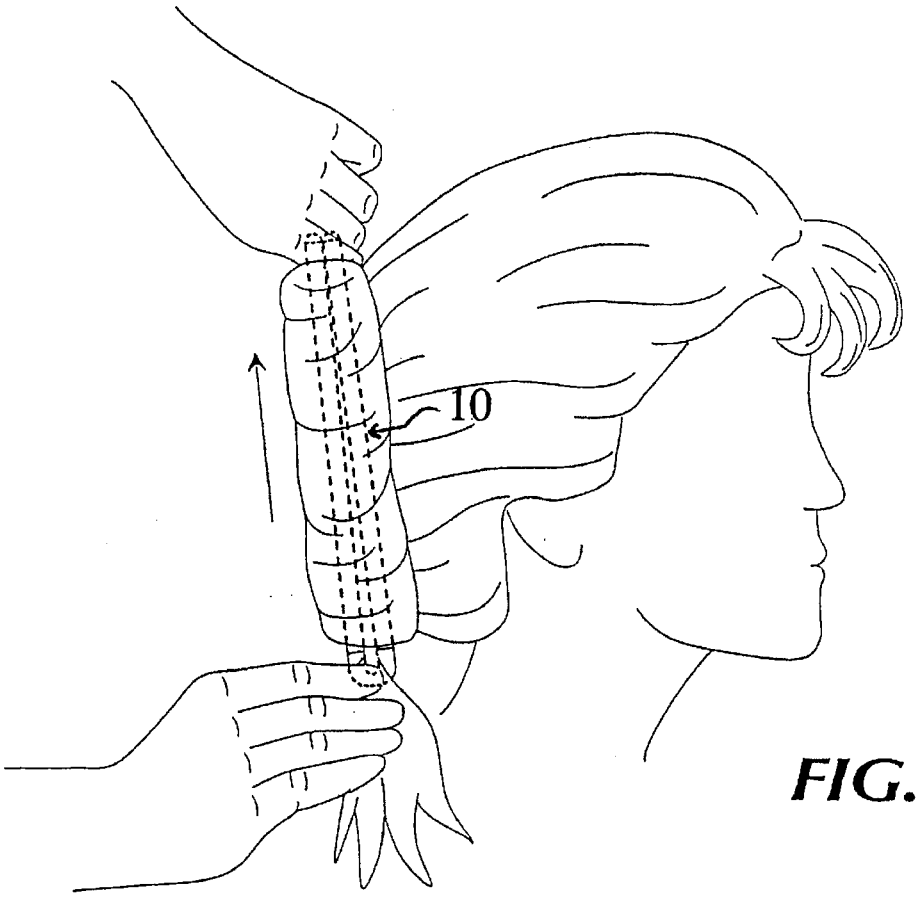
Figure 6:
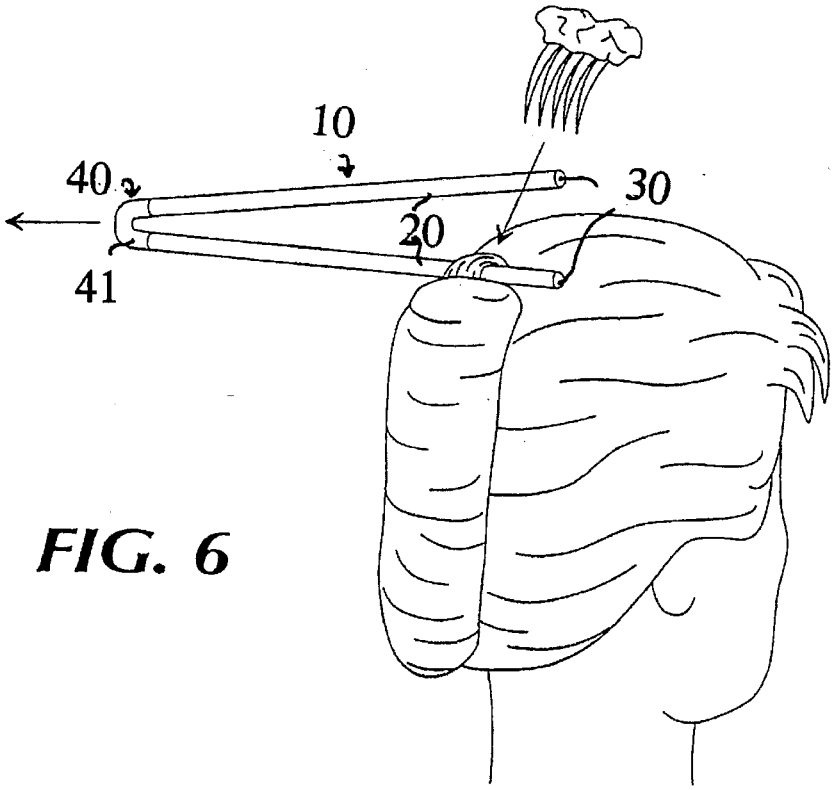

In use, as depicted in FIGS. 3, 4, 5 and 6, an individual or professional hairdresser will first comb or brush a length of hair to be styled perpendicularly away from the subject's head. The tool 10 is then used to clamp down on and hold the hair between the elongated tubes 20 at an appropriate point for the particular coif desired, as shown in FIG. 4. The hair is then wound around said tubes 20 and is twisted or rotated towards the subject's head in a manner suitable for whatever coif is desired. Once the hair has been twisted or rotated into the desired style, the flexible coupling 40 of the tool 10 may be used to pull a section of clamped hair through the coiled hair for further styling, as shown in FIG. 5, or the tool 10 may simply be removed from the hair by sliding the tubes 20 out of the hair in the direction of the flexible coupling 40. Once the particular style has been completed and the tool 10 has been removed from the hair, the style may be secured by a comb or hair pins for permanency as shown in FIG. 6.

Figure 2:
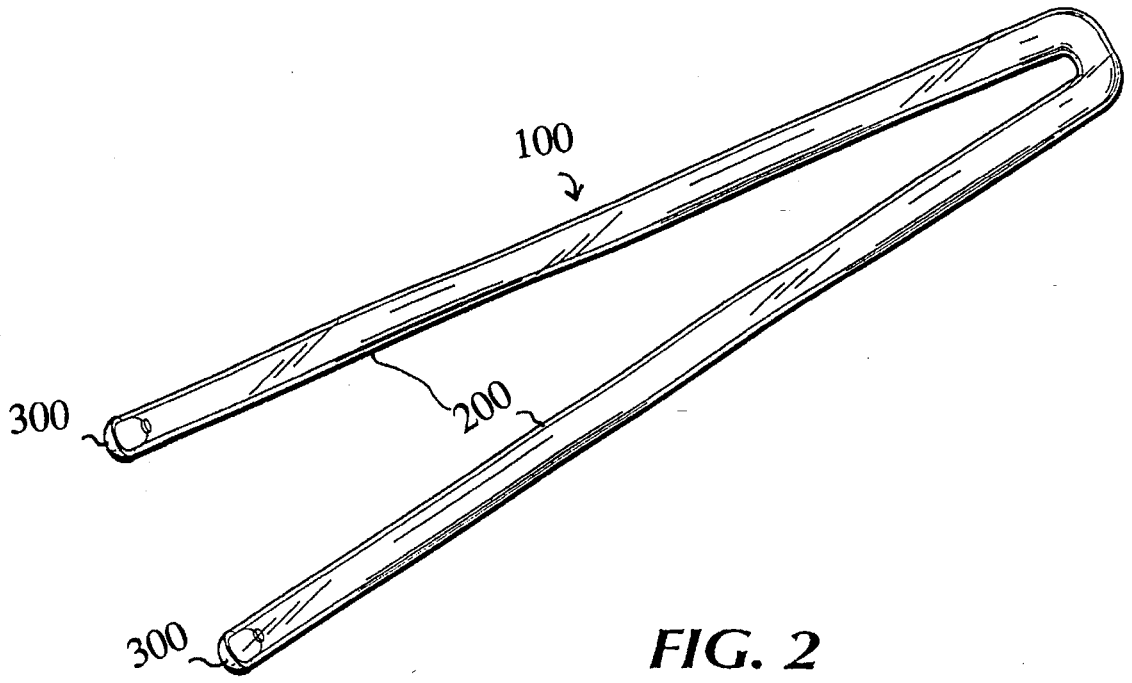
FIG. 2 is a plan view of an alternate embodiment of the invention.
Figure 3:
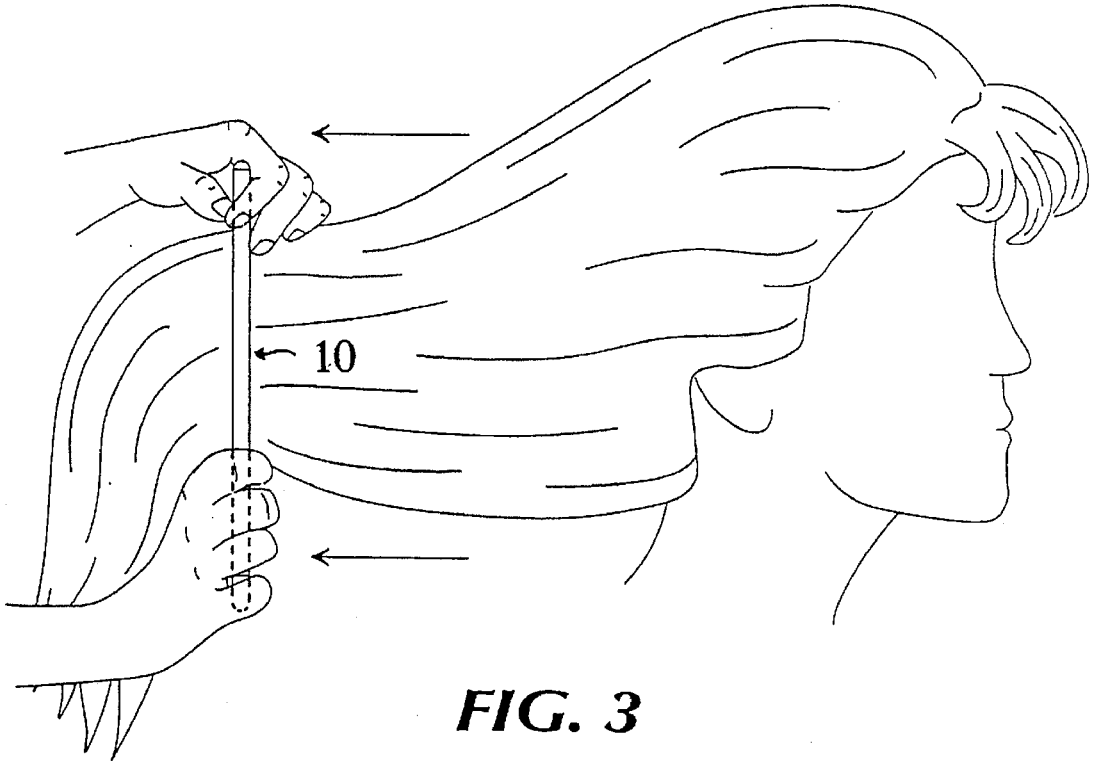
FIGS. 3, 4, 5 & 6 are sequential views of the invention being used by an individual to create a particular hairstyle.

FIG. 2 discloses an alternate embodiment of the invention comprising a singular "V"-shaped member 100 having elongated arms 200. Said "V"-shaped member 100 is depicted in tubular form in the drawings, however, the member 100 may also be of solid construction such as a solid rod. In this embodiment, said member 100 is constructed of plastic material, or the like, said material having sufficient rigidity to allow its user to perform the rotational and twisting manipulations required to successfully style an individual's hair yet having sufficient flexibility and durability to allow the frequent bending and flexing required to use said member 100. When comprised of tubular material, the arms 200 of said member 100 are provided with end plugs 300 at the end of each arm 200.

While the invention has been particularly shown and described with reference to the preferred embodiments thereof, it will be understood by those skilled in the art that various alterations in form, detail and construction may be made therein without departing from the spirit and scope of the invention.

The embodiments of the invention in which an exclusive property right or privilege is claimed, are defined as follows:

1. A hair styling tool comprising a pair of elongated rods connected to each other at one end by a flexible coupling member, wherein said coupling member comprises a "V" shaped coupler having protruding ends attached to said elongated rods.

2. A method of hair styling comprising the steps of:

combing or brushing a length of hair perpendicularly away from a subject's head;

using a styling tool comprising a pair of elongated rods connected at one end to a flexible coupling, grasp and hold the subject's hair at a chosen point along the length of said hair;

using said styling tool to rotate and/or twist the hair around the elongated rods and toward the subject's head in a manner suitable for the particular style being created;

using the flexible coupling ends of the styling tool to pull a section of hair through the coifed hair if desired;

removing said styling tool from the subject's coiled hair; and securing the completed style with a retaining means.

3. The method of claim 2, wherein said elongated rods comprise rigid hollow tubes.

4. The method of claim 2, wherein said flexible coupling comprises a semi-rigid member having sufficient flexibility to allow the elongated rods of the hair styling tool to be operated or moved toward one another in a clamping manner.

5. The method of claim 2, wherein said hair styling tool comprises a "V"-shaped coupler having protruding ends attached to said elongated rods.

6. The method of claim 2, wherein said elongated rods of said hair styling tool are constructed of rigid plastic.

7. The method of claim 6, wherein the rigid plastic is acrylic resin.

8. The method of claim 2, wherein the retaining means is a comb.

9. The method of claim 2, wherein the retaining means is at least one hair pin.

10. A method of styling hair comprising the steps of:

combing and brushing a length of a subject's hair perpendicularly away from the subject's head;

using a styling tool comprising a "V"-shaped member having elongated arms to grasp and hold the subject's hair at a chosen point along the length of said hair;

using said styling tool to rotate and/or twist the subject's hair around the arms of said tool and toward the subject's head in a manner suitable for the particular hairstyle being created;

using said tool to pull a section of the subject's hair through the coifed hair if desired;

removing said styling tool from the subject's coifed hair; and, securing the completed style with a retaining means.

11. The method of claim 10, wherein said "V"-shaped member comprises a hollow tube.

12. The method of claim 10, wherein said "V"-shaped member comprises a solid rod.

13. The method of claim 10, wherein said "V"-shaped member has sufficient flexibility and durability to allow the arms of said member to be frequently flexed and bent toward each other without damage to said member.

14. The method of claim 10, wherein the retaining means is a comb.

15. The method of claim 10, wherein the retaining means is at least one hair pin.

* * * * *